United States Patent [19]

Vogt et al.

[11] 4,185,550

[45] Jan. 29, 1980

[54] MINESWEEP OBSTRUCTOR WITH CABLE DISPENSING MEANS

[76] Inventors: Charles C. Vogt, 7208 Denton Rd., Bethesda, Md. 20014; Royal Weller, 620 Deodan Ave., Oxnard, Calif. 93030

[21] Appl. No.: 495,369

[22] Filed: Mar. 18, 1955

[51] Int. Cl.[2] ..... F42B 22/10

[52] U.S. Cl. ..... 102/13; 102/15

[58] Field of Search ..... 102/13, 15

[56] References Cited

FOREIGN PATENT DOCUMENTS 484810 10/1929 Fed. Rep. of Germany ..... 102/13

128703 6/1919 United Kingdom ..... 102/13

*Primary Examiner*—Charles T. Jordan

*Attorney, Agent, or Firm*—R. S. Sciascia; A. L. Branning

EXEMPLARY CLAIM

1. In a mooring device for an aerial launched mine adapted to be dropped into a body of water, in combination, a buoyant member, a casing releasably locked to said member and separable therefrom upon impact of the device with the water, locking means including a plurality of detents carried by said casing for releasably locking the casing to said member, impact responsive means mounted on the casing for releasing said locking means in response to said impact, and a length of mooring cable arranged to be payed out as the casing separates from said member and sinks to the bed of the body of water for mooring the mine beneath the surface of the water.

8 Claims, 9 Drawing Figures

MINESWEEP OBSTRUCTOR WITH CABLE DISPENSING MEANS

The invention described herein may be manufactured and used by or for the Government of the United States of America for governmental purposes without the payment of any royalties thereon or therefor.

The present invention relates to aircraft-laid, moored mines and more particularly to an anchor for use with a minesweep obstructor. More specifically, the invention relates to a mine anchor suitable for use with an anti-sweep device of the submersible type and adapted to moor the device in a predetermined position beneath the surface of a body of water within the path of travel of a sweep wire whereby an explosive charge contained within the device is exploded in response to the engagement of the device by the sweep wire, the explosive charge being sufficiently large to effectively destroy the sweep wire.

The anchor of the present invention comprises a casing detachably secured to a hermetically sealed streamlined mine or obstructor, the anchor having impact responsive devices for releasing the anchor from the mine upon impact of the mine with the surface of a body of water and cable dispensing means arranged within the anchor. The dispensing means is provided with a predetermined length of cable, the length of which is determined by the particular conditions encountered during the mine planting operation and the depth of the water wherein the mine is to be planted. The cable is coiled within the dispensing means and has one end secured to the anchor housing, the other end thereof being secured to a conventional firing mechanism arranged within the buoyant mine casing, the firing mechanism being similar to the firing mechanism described and claimed in the copending application of Joseph D. Turlay, Ser. No. 432,455, filed Feb. 26, 1942, titled, Means for Destroying a Sweep Mine. As the mine is released from the anchor casing in the aforesaid manner the cable is payed out as the anchor sinks to the bed of the body of water whereupon in accordance with the predetermined length of cable within the dispensing device the mine is moored at a predetermined depth below the surface of the body of water.

An object of the present invention is the provision of a new and improved anchor for use with an aircraft launched marine mine.

Another object of the invention is provision of an anchor device for mooring a positively buoyant mine in a predetermined position beneath the surface of a body of water.

Another object of the invention is the provision of an anchor releasably locked to a buoyant mine wherein means responsive to impact of the mine with the surface of a body of water releases the anchor from the buoyant mine.

Still another object of the invention is the provision of an anchor device for a mine adapted to be dropped from an aircraft in flight and which upon striking the water will automatically release itself from the mine.

A further object of the invention is the provision of an anchor mechanism for a mine wherein novel locking means maintain the anchor locked to the mine until the mine strikes the surface of a body of water.

A still further object of the invention is the provision of an anchor mechanism for a mine having normally locked shearing elements adapted to be released as the mine is released from an aircraft in flight and which is adapted to release the normally locked anchor and mine as the shearing elements are actuated upon impact of the mine with the surface of a body of water.

Other objects and many of the attendant advantages of this invention will be readily appreciated as the same becomes better understood by reference to the following detailed description when considered in connection with the accompanying drawings wherein.

Figure 1:
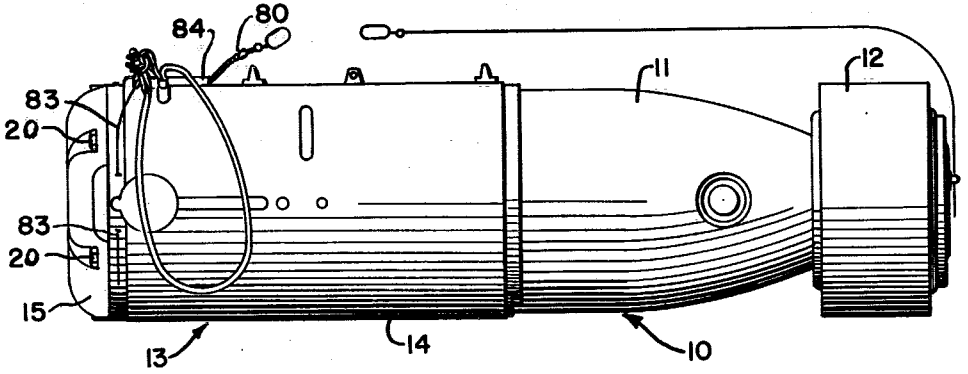
FIG. 1 is an elevational view of the mine anchor constructed in accordance with the present invention illustrating a buoyant mine releasably secured thereto.

Referring now to FIG. 1 of the drawings there is shown a float member 10 comprising a casing 11 having a conventional parachute pack 12 carried on the trailing end and an anchor generally indicated by the reference character 13 detachably secured to the other end thereof.

Figure 2:
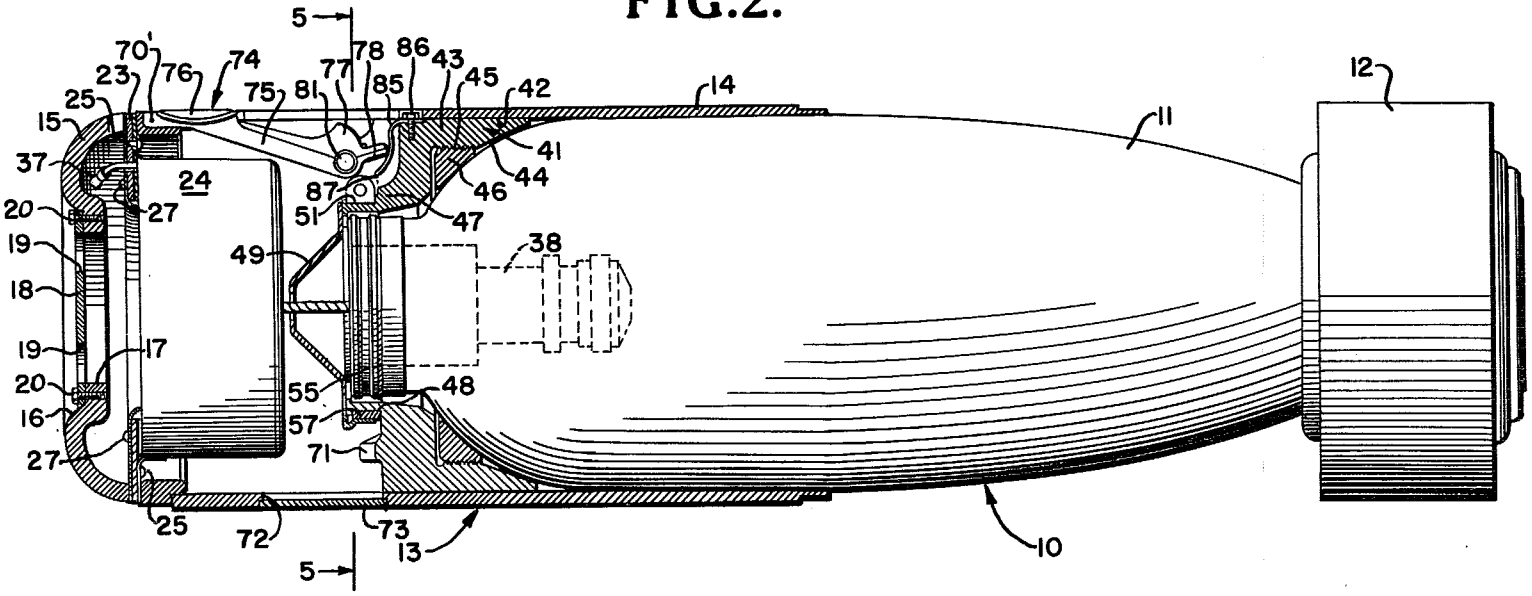
FIG. 2 is a view partially in section and partially in elevation of the arrangement of FIG. 1.

The anchor 13 constructed in accordance with the present invention comprises a housing 14 having a portion of the mine casing 11 telescoped therein as more clearly shown on FIG. 2. The housing 14 is provided with a nose cap 15 having a centrally disposed depression 16 and an opening 17 in communication with the interior of the anchor housing 14. A plate 18 having a plurality of ports 19 is disposed within the depression 16 superjacent the opening 17 and secured to the cap 15 by bolts 21.

Figure 3:
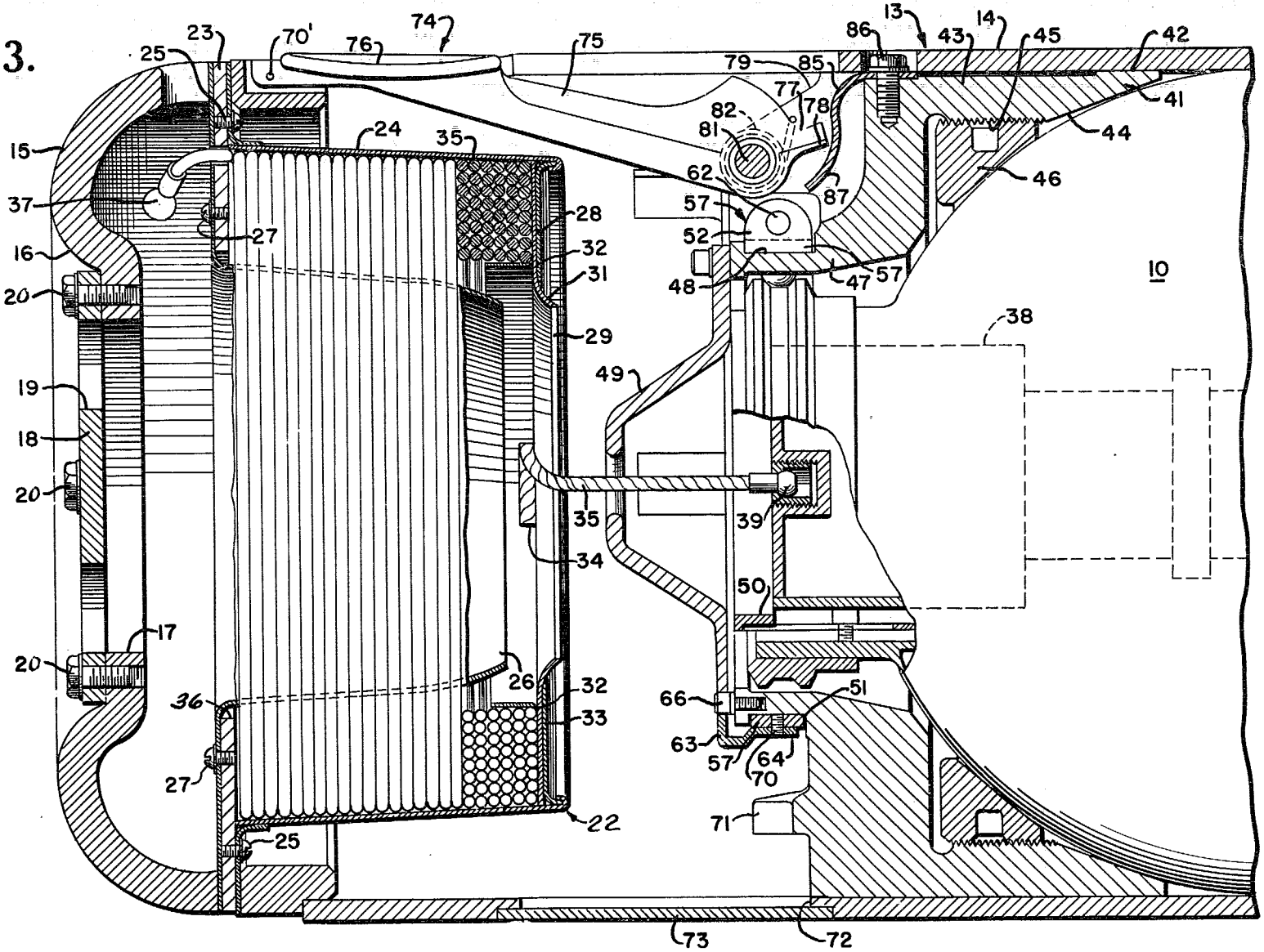
FIG. 3 is an enlarged fragmentary sectional view of the anchor illustrating a mine releasably locked thereto.

As more clearly shown on FIG. 3 a cable dispenser generally indicated by the reference character 22 is disposed within the housing 14. The dispenser comprises an annular member 23 disposed at one end thereof and having a casing 24 secured to one surface thereof as at 25. A cable retaining element 26 is secured to the other surface thereof as at 27 and arranged in spaced relation with respect to the casing 24. The casing 24 is provided with an end wall 28 having a centrally disposed opening 29 formed therein bordering on an annular curved cable guide member 31 integrally formed with the end wall 28. Secured to the wall 28 as at 32 in spaced relation with respect to the element 26 and the casing 24 is an annular member 33. Closely fitted within the inner coils of the cable is a tear strip 30 having an elongated slot 34 formed therein, FIG. 3, as illustrated. The ring 23, it will be noted, FIG. 2, is disposed between the cap 15 and one end of the casing 14 and is secured to the casing by the bolts 20, FIG. 1, whereupon the dispenser is supported within the casing 14.

A mooring cable 35 is disposed within the dispenser and coiled about the retaining member 26 between the casing 24 and annular member 33. One end of the cable extends through an opening 36 in plate 23 and connected thereto as at 37, the other end thereof initially extending through the elongated slot 34 formed in member 30 and secured to the conventional firing mechanism 38 as at 39. Whereas for the purpose of illustration the member 30 is shown in position within the casing 24, it will be understood that in practice the member 30 is removed from the casing during the assembly of the device prior to launching.

As more clearly shown on FIG. 3 a mine support generally indicated by the reference character 41 is disposed within and secured to the housing 14 as at 42. The support comprises an annular flange 43 having a tapered seat 44 terminating in an annular threaded wall 45 in engagement with an adjusting member 46. The support is further provided with an extension or nipple 47 having an annular groove 48 formed therein and a substantially U-shaped cable guide or support 49 secured thereto to prevent fouling of the mooring cable as the cable is payed out and to maintain the firing ring 50 of the mine in a safe position as best shown on FIG. 3.

Figure 5:
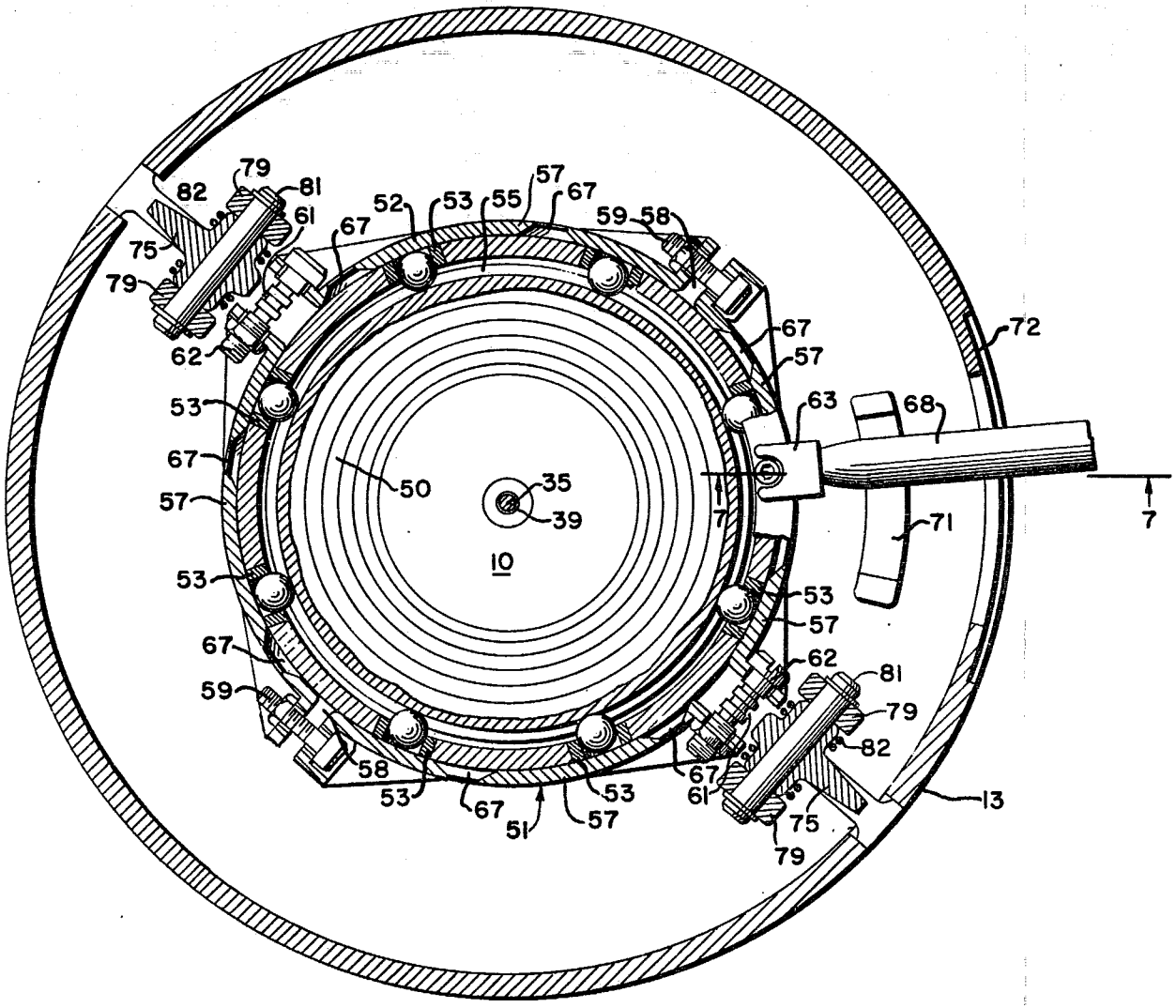
FIG. 5 is an enlarged sectional view taken substantially on the line 5—5 of FIG. 2 illustrating the ball type locking mechanism in a locked position.
Figure 6:
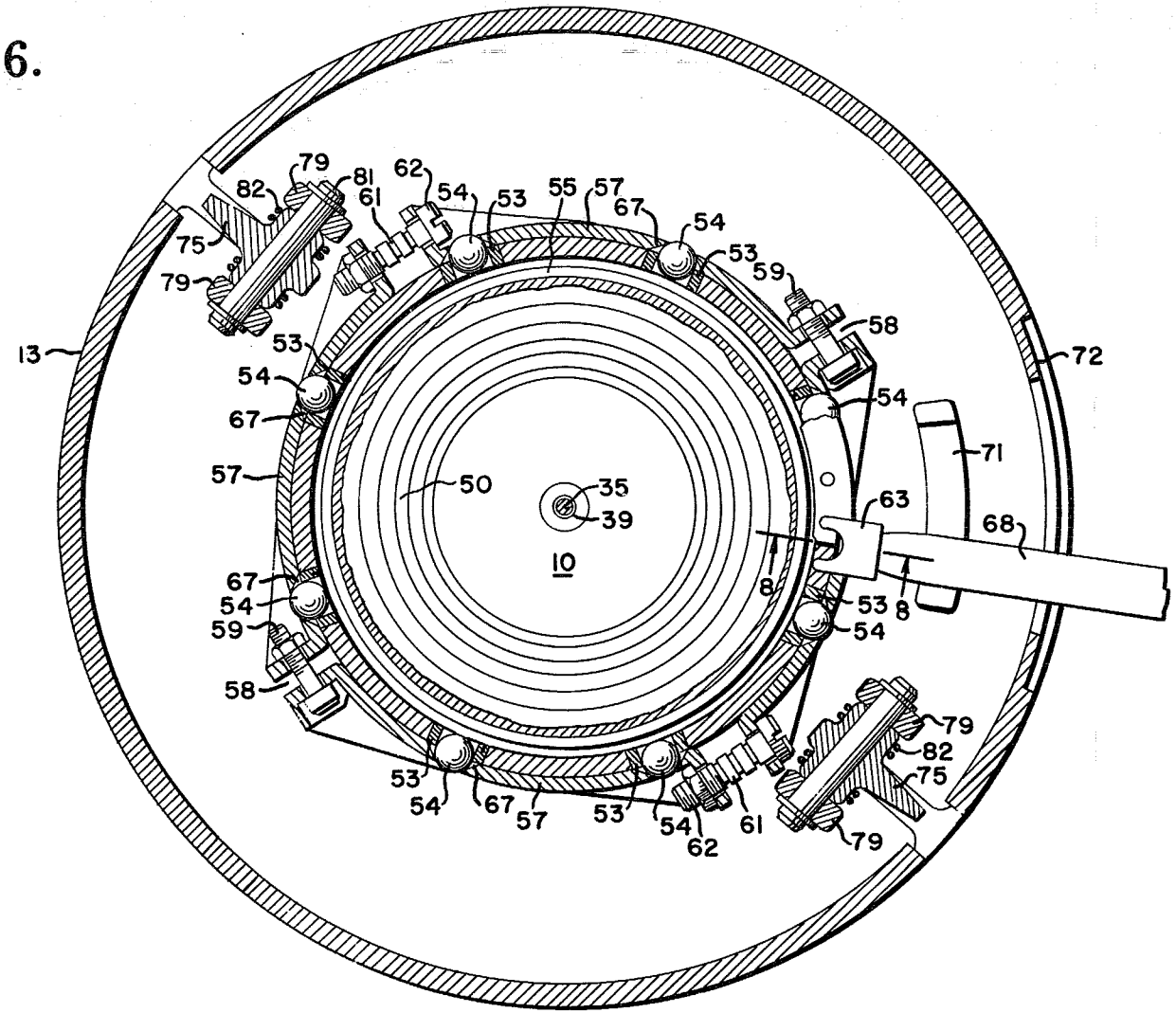
FIG. 6 is a view similar to FIG. 5 with the locking mechanism in a release position.

A locking mechanism generally indicated by the reference character 51 comprises an annular locking ring 52 and a plurality of mutually spaced bushings 53 arranged in the nipple 47, each bushing having a ball or detent 54 arranged therein as best shown on FIGS. 5 and 6.

The mine casing is provided with an annular recess 55, the balls 54 being maintained in locking engagement with the recess 55 by the locking ring 52. The ring 52 is rotatably arranged within the groove 48 and comprises four semi-circular members 57 secured together as at 58 by a pair of diametrically disposed non-shearable bolts 59, and as at 61 by a pair of diametrically disposed shearable bolts 62. By this arrangement the mine and anchor are releasably locked together and will remain locked until the mine strikes the surface of a body of water. The locking ring 52 is prevented from rotation after the mine has been locked to the anchor by a locking tab 63 secured to the ring as at 64 such, for example, as welding the parts together and having the bifurcated end 65 disposed between a bolt or pin 66 attached to the nipple 47 after the locking ring 52 has been rotated from an initial position to a locked position, FIG. 5, whereupon the mine and anchor are securely locked.

Figure 8:
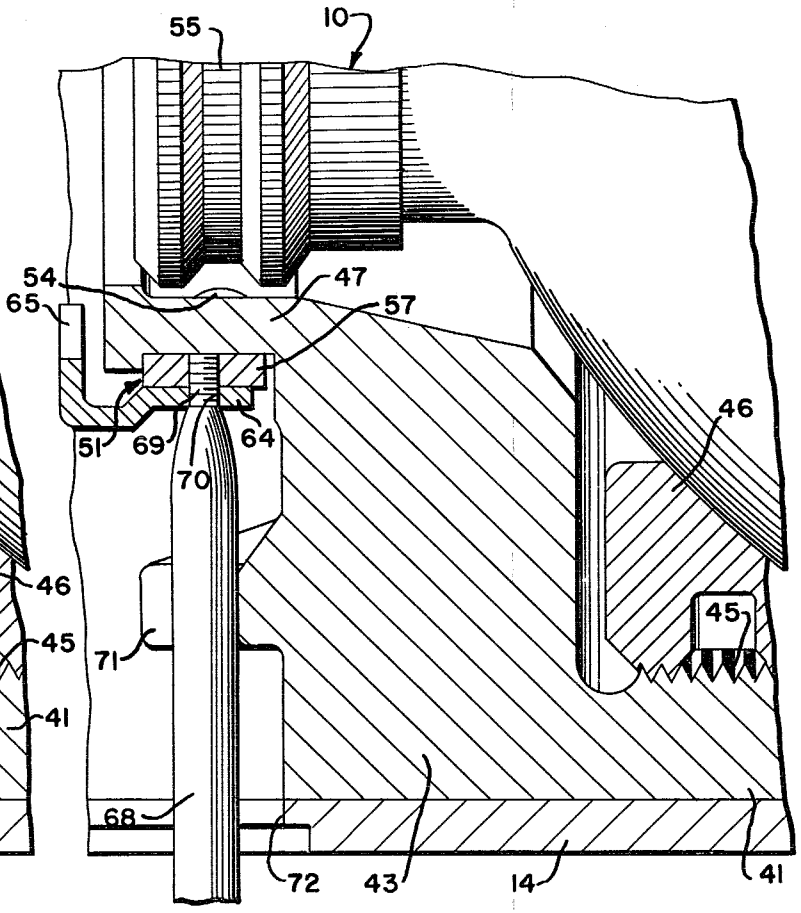
FIG. 8 is a sectional view taken on the line 8—8 of FIG. 6.
Figure 7:
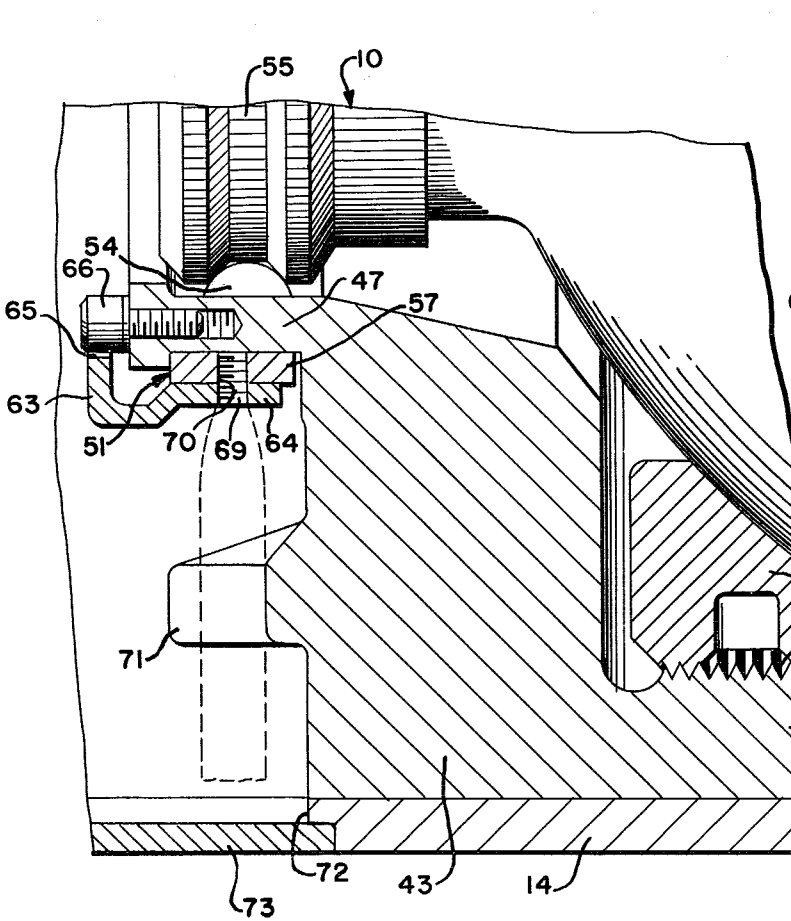
FIG. 7 is a sectional view taken on the line 7—7 of FIG. 5.

In FIG. 6 the locking mechanism 51 is shown in a release position. It will be noted that the locking balls 54 are each disposed within an opening 67 formed in the members 57, the walls of each opening being constructed in such a manner as to cam the balls into locking engagement with the annular recess 55 formed in the mine 11 when the ring 52 is rotated a predetermined amount. The ring 52 is actuated by a lever 68 having a stub 69 formed thereon in threaded engagement with corresponding openings 70 formed in the locking clip 63 and one of the members 57, FIG. 8. A guide and stop member 71 are carried by the support for guiding and stopping the lever when the ring 52 has been actuated from an initial position to a locked position, the lever being inserted into openings 70 to operate the locking ring 52 through passageway 72 formed in the anchor housing 14, the passageway thereafter being closed and sealed by a cover plate 73, FIGS. 2 and 3.

As more clearly shown on FIGS. 2 and 3 a pair of diametrically disposed impact responsive paddles generally indicated by the reference character 74 are arranged within the housing 14. The paddles comprise an elongated shank 75 having a circular impact member 76 formed on one end and an anvil 77 formed on the other end thereof, the anvil being provided with a shearing element 78 adapted to shear the bolts 63 as the paddles are actuated in response to impact of the mine with the surface of the water. Each of the paddles 74 is pivotally mounted between a pair of supports 79 by a pin 81 carried by the supports. The aforesaid paddles are each provided with a pair of biasing springs 82 for urging the paddles outwardly of the anchor as the paddles are released, each of the paddles being releasably secured to the anchor by a conventional arming wire 83 disposed within an opening 70' formed in the paddles and corresponding openings arranged within the anchor housing. The aforesaid arming wires are each connected to a conventional dispenser 84, operatively connected to the aircraft by a flexible element 80, the dispenser being provided with sufficient slack line to prevent release of the paddles by the arming wire until the mine has cleared the bomb bay after being released from the aircraft.

Figure 4:
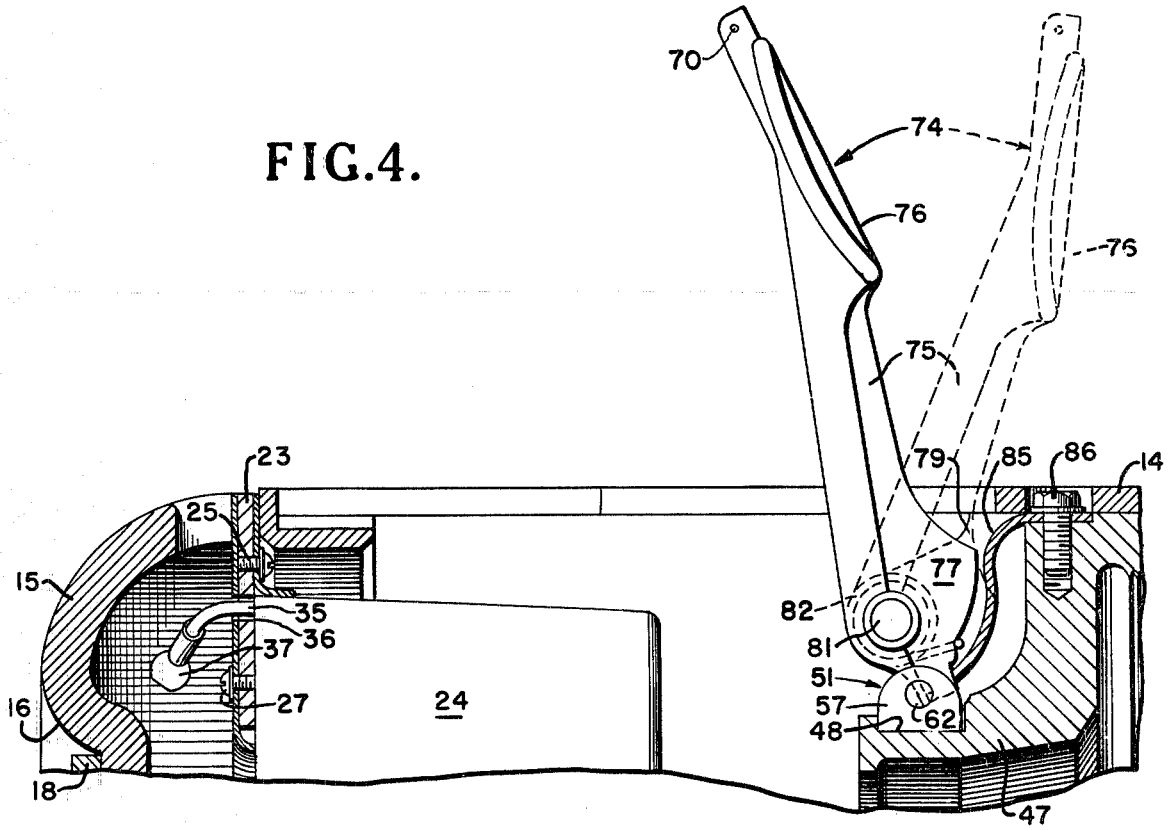
FIG. 4 is an enlarged fragmentary sectional view of an anchor illustrating an impact responsive paddle in a released position in full outline and in dashed outline upon water impact.
Figure 9:
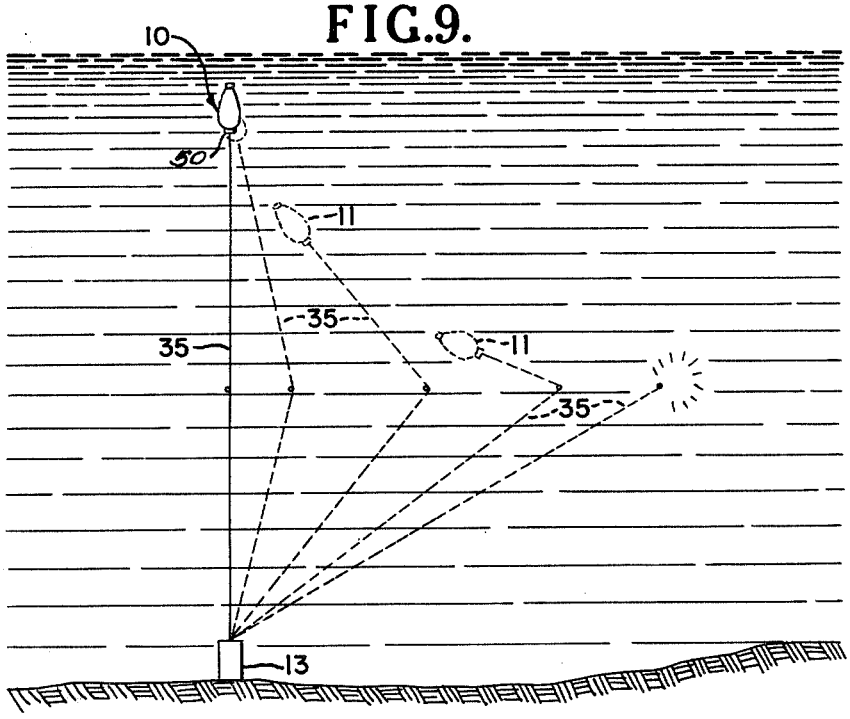
FIG. 9 is a diagrammatic view illustrating the mine moored within a body of water by the anchor and the successive positions assumed by the mine when the mooring cable thereof is engaged by a sweep wire.

The paddles are each provided with a latch spring 85 having one end secured to the support as at 86 with the free end 87 disposed within the anchor housing 14 in proximate relation with respect to the anvil portions 77 of each paddle, FIGS. 2 and 3. It will be understood that as the mine is released from the aircraft the paddles 74 are urged outwardly by the biasing springs 82, FIG. 4, whereupon the latch springs 85 engage the anvils and maintain the paddles in the extended position with the shearing elements 78 thereof in proximate relation with respect to the shearable members 62. Upon impact of the mine with the surface of the body of water the paddles 74 are actuated to a position as shown in dashed outline, FIG. 4. When this occurs the shearing elements 78 on anvils 77 are forcibly driven into engagement with the shearable pin 62 with sufficient force to sever the pin whereupon the locking mechanism is released and the mine separates from the anchor. As the anchor is released from the mine water enters the anchor by way of ports 19 and the anchor sinks to the bed of the body of water whereupon a predetermined length of cable is payed out from the cable dispenser and thus the mine is moored a predetermined depth beneath the surface of the body of water, FIG. 9. It will be understood, however, that the mine operates to explode and destroy the sweep wire as the sweep wire engages the mooring cable and moves into firing engagement with the firing ring 50 whereupon the mine is exploded.

The cable dispenser has a capacity preferably of about 600 feet of cable, the length of cable being determined by the particular condition encountered during a mine planting operation. The minimum mooring depth of the mine, however, is substantially 24 feet, the maximum mooring depth thereof is 300 feet. Moreover, the minimum anchor planting depth is substantially 90 feet, the maximum anchor planting depth being substantially 600 feet. To facilitate the cutting of the cable at the desired mooring length thereof a suitable color-code may be employed on the cable such, for example, as two inch blue and yellow bands, the distance between the blue bands being substantially 100 feet and the distance between the yellow bands being substantially 10 feet. Thus by this arrangement the desired length of cable is readily measured and the excess length thereof cut off prior to planting the mine in the water such that the mine is moored at a predetermined depth below the surface of the body of water.

In operation, as the mine is released from the aircraft and falls a predetermined distance therefrom the aforesaid arming wires 82 are withdrawn and the paddles are released and concurrently therewith another arming wire is withdrawn from the parachute pack control unit. When this occurs the paddles are urged outwardly and the control unit is set in operation and is adapted to function to eject the cover from the pack at a predetermined altitude. When this occurs the parachute is withdrawn from the pack by the cover and the mine and anchor securely locked together float toward the water. When the mine strikes the water, water impact forcibly drives the shearing element 78 on the anvils 77 into engagement with the shearable bolts 62 shearing the bolts and releasing the locking mechanism 51, and concurrently therewith the parachute pack release is actuated to a release position and the pack is released from the mine casing. As the anchor descends within the water, the mooring cable is payed out and thus when the anchor comes to rest on the bed of the body of water, the mine is moored at the desired depth. It will be understood, however, that the mine is armed after it has reached a depth greater than 10 feet. Moreover, the aforesaid support 49 maintains the firing ring in engagement with the lower end of the firing mechanism housing and thus prevents the firing mechanism from arming before the mine and anchor are released and separated.

From the foregoing it will be apparent that a new and improved mine anchor has been devised for use with an anti-sweep device of the submersible type adapted to moor the device in a predetermined position beneath the surface of a body of water within the path of travel of a sweep wire and which is constructed and arranged to be releasably secured to the mine and released therefrom upon impact of the mine with the surface of a body of water.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. In a mooring device for an aerial launched mine adapted to be dropped into a body of water, in combination, a buoyant member, a casing releasably locked to said member and separable therefrom upon impact of the device with the water, locking means including a plurality of detents carried by said casing for releasably locking the casing to said member, impact responsive means mounted on the casing for releasing said locking means in response to said impact, and a length of mooring cable arranged to be payed out as the casing separates from said member and sinks to the bed of the body of water for mooring the mine beneath the surface of the water.

2. In a mooring device for an aerial launched mine adapted to be dropped into a body of water, in combination, a buoyant member, a casing releasably locked to said member and separable therefrom upon impact of the device with the water, a plurality of locking balls carried by said casing in locking engagement with the member, a detachable element in engagement with said locking balls for maintaining the balls in locking engagement with said member until said element is detached therefrom, impact responsive means mounted on the casing for detaching said element in response to said impact, and a length of mooring cable arranged within the casing and payed out as the casing separates from said member and sinks to the bed of the body of water for mooring the mine beneath the surface of the water.

3. In a mooring device for an aerial launched mine adapted to be dropped into a body of water, in combination, a buoyant body, a casing releasably locked to said body and separable therefrom upon impact of the mine with the water, a plurality of locking balls carried by said casing in locking engagement with said member, means including a pair of shear elements for maintaining the balls in locking engagement with said member until said elements are severed, a pair of impact responsive devices pivotally mounted on the casing for severing said shear elements as said devices are actuated in response to said impact, a cable dispenser arranged within the casing, and a predetermined length of mooring cable disposed within the dispenser and adapted to be payed out as the casing separates from said body and sinks to the bed of the body of water for mooring the mine a predetermined distance beneath the surface of the water.

4. In a mooring device for an aerial launched mine adapted to be dropped and moored a predetermined distance beneath the surface of a body of water, in combination, a buoyant body, a casing releasably locked to said body and separable therefrom upon impact of the device with the water, means including a plurality of shear elements for releasably locking the casing to said body, water actuated means pivotally mounted within the casing for severing said shear elements as said water actuated means are forcibly driven into engagement with said shear elements in response to said impact, a cable dispenser arranged within the casing, and a predetermined length of mooring cable disposed within the casing, said cable having one end secured to said buoyant body and the other end thereof secured to the casing for mooring the body a predetermined distance below the surface of the water.

5. In a mooring device for a mine sweep obstructor adapted to be launched from an aircraft in flight into a body of water, in combination, a buoyant body for said mine, an anchor releasably locked to said buoyant body and separable therefrom upon impact of the device with the water, a plurality of locking balls carried by said anchor in locking engagement with said body, means including a pair of shear pins for maintaining said balls in locking engagement with said body until said pins are severed, a pair of normally locked impact responsive paddles pivotally mounted on said anchor, means carried by said aircraft for releasing said paddles after said device is released from the aircraft, anvil means on each of said paddles in alignment with said pair of shear pins respectively for severing said pins as the anvil means are forcibly driven into engagement therewith by said paddles in response to said impact, a cable dispenser arranged within said anchor, and a predetermined length of mooring cable disposed within said anchor for mooring the buoyant body a predetermined distance below the surface of the water when said cable has been payed out.

6. In a mooring device for a mine sweep obstructor adapted to be launched from an aircraft in flight into a body of water, in combination, a buoyant body for said mine, an anchor releasably locked to said buoyant body and separable therefrom upon impact of the device with the water, a plurality of locking balls carried by said anchor in locking engagement with said body, a split ring releasably secured to said casing in engagement with said balls for maintaining the balls in locking engagement with the body until said ring is released, means including a pair of shear pins for releasably securing said ring to the casing, a pair of impact responsive paddles pivotally mounted on said anchor and normally disposed within said anchor and locked thereto, means secured to said aircraft and detachably secured to said paddles for releasing the paddles after said device is released from the aircraft, spring means on each of said paddles for moving the paddles in a direction outwardly of the anchor as the paddles are released, anvil means on each of said paddles in alignment with said shear pins for severing the pins and releasing said split ring as the anvil means are forcibly driven into engagement with said pins, by said paddles in response to impact of the paddles with the water, and a length of cable arranged within said anchor for mooring the buoyant body a predetermined distance below the surface of the water after the anchor is released from the body and sinks to the bed of the body of water.

7. An anchor for mooring a buoyant sweep cable obstructor within a body of water comprising a casing, means including a pair of shear bolts for releasably securing said casing to the obstructor, water actuated means pivotally mounted within the casing for releasing said securing means and causing separation of said casing from the obstructor as the water actuated means is forcibly driven into engagement with said shear bolts with sufficient force to sever said bolts upon impact of the casing with the water, and a length of mooring cable arranged within the casing and payed out as the casing is separated from the obstructor and sinks to the bed of the body of water for mooring the obstructor beneath the surface of the water.

8. An anchor for mooring a buoyant mine a predetermined distance below the surface of a body of water comprising a casing, means including a plurality of shear elements carried by said casing for detachably securing said casing to the mine, water actuated means pivotally mounted within the casing for releasing said securing means and causing separation of said casing and mine as the water actuated means is forcibly driven into engagement with said shear elements with sufficient force to sever the elements upon impact of the casing with the water, a cable dispenser arranged within the casing, a length of mooring cable disposed within the dispenser for mooring the mine a predetermined distance below the surface of the water as said casing is separated from said mine and sinks to the bed of the body of water.

* * * * *